US006047255A

United States Patent [19]

Williamson

[11] Patent Number: 6,047,255

[45] Date of Patent: Apr. 4, 2000

[54] METHOD AND SYSTEM FOR PRODUCING SPEECH SIGNALS

[75] Inventor: Robert Alan Williamson, Aurora, Canada

[73] Assignee: Nortel Networks Corporation, Montreal, Canada

[21] Appl. No.: 08/985,058

[22] Filed: Dec. 4, 1997

[51] Int. Cl.[7] ..... G10L 3/02; G10L 9/00

[52] U.S. Cl. ..... 704/212; 704/267; 704/275

[58] Field of Search ..... 704/212, 267, 704/275

[56] References Cited

U.S. PATENT DOCUMENTS

| | | | |
|---|---|---|---|
| 4,964,168 | 10/1990 | Bierlein et al. | 704/275 |
| 5,029,200 | 7/1991 | Haas et al. | 379/89 |
| 5,153,913 | 10/1992 | Kandefer et al. | 704/212 |

*Primary Examiner*—David R. Hudspeth
*Assistant Examiner*—Robert Louis Sax

[57] ABSTRACT

A method and system for producing speech signals is disclosed. The speech signals are produced by sequentially reproducing a series of stored speech signal segments. The speech signals may be used to generate a voice message. The signals are formed by reproducing signal segments for system announcement messages and beginning, end and word-pair fragments for "key" words. The system announcement messages and "key" words define a dictionary for the system. The signal segments for word pair fragments correspond to the end portion of one word, a transition to another word and a beginning portion of that other word. The transition between sequentially produced "key" words in a voice message generated from a signal produced from word pair fragments is audibly smooth. The resulting speech signal may correspond to any sequences of words from the dictionary. The method and system are suited for telephony applications, such as voice mail or directory assistance applications.

12 Claims, 12 Drawing Sheets

METHOD AND SYSTEM FOR PRODUCING SPEECH SIGNALS

FIELD OF THE INVENTION

The present invention relates to a method and system for producing speech signals, and more particularly, to a method and system for producing a speech signal for generating a voice message containing a sequence of discrete words or phrases.

BACKGROUND OF THE INVENTION

Modern applications often require generation of voice messages containing a sequence of words. The voice messages may be generated from stored speech signal segments. Each signal segment corresponds to one of a plurality of individual words or phrases in a defined dictionary. Typically, the signal segments are digitally sampled versions of spoken words, stored in a computer readable memory. The segments are concatenated to form the complete voice message. The dictionary varies from application to application, but typically contains words or phrases that may be combined with other words or phrases in the dictionary to produce a large variety of meaningful voice messages. For example, the dictionary may contain the spoken numerals 0–9; the letters of the alphabet A–Z; common words; or any combination of these.

Systems used in providing telephony services generate voice messages containing spoken telephone numbers in response to a caller directory inquiry. Similar systems may be used to generate voice messages containing spoken versions of zip or postal codes; spelled names or words; monetary amounts (for example "two dollars and eight cents"); or the like. Telephone "caller identification" devices may use such systems to speak the phone number of a caller. As well, voice mail systems generate messages comprised of system produced voice messages and user recorded messages.

Present systems that generate voice messages typically do so by producing a signal formed by sequentially reproducing stored signal segments corresponding to each individual word or phrase in a dictionary. The stored segments are typically independent and are formed by sampling unrelated recordings of the words and phrases in the dictionary. Each reproduced signal segment is spaced from the next by a signal segment corresponding to a gap of silence or a pause. In a generated voice message, the pauses allow a listener to perceive a connection between the end of one word and the beginning of the next. However, the use of pauses combined with the use of signal segments corresponding to unrelated spoken words cause the generated voice message to sound staccato, and unnatural.

One solution to address the problem of staccato speech has involved storing signal segments corresponding to several versions of each word or phrase in a dictionary. Each version has a different intonation. In one implementation, for example, an automated directory assistance service uses signal segments corresponding to three versions of each numeral from 0–9 to generate voice messages containing spoken digits of telephone numbers. Signal segments corresponding to versions of each digit having a rising, falling, and level intonation are stored. Depending on whether a digit is generated at the beginning, end or middle of a sequence of digits, signal segments corresponding to the version of the digit having rising, falling or level intonation, as required, are used. A resulting voice message containing a sequence of digits sounds more natural to the listening ear.

The listener perceives the unrelated digits as being related by their relative intonation. However, such a system like other known systems produces the sequence of words from signal segments corresponding to individual, substantially unrelated, words. Again, fixed pauses are generated between words.

These known systems ignore the natural interrelation between adjacent words, in a sequence of spoken of words. As noted, the speech produced by these systems sounds somewhat unnatural. Moreover, because gaps of silence of fixed duration are typically generated between individual words, the produced voice message is somewhat longer than a naturally spoken sequence of words. Even if the gaps are extremely short, the transitions to and from the gaps are both time consuming and create the unnatural sounding speech.

The present invention attempts to overcome some of the disadvantages of known systems.

SUMMARY OF THE INVENTION

It is an object of the present invention to produce a speech signal for generating a voice message containing a sequence of words. The transition between words in the message is smooth.

Advantageously, the present invention allows for generating a voice message without generating deliberate gaps between words in the message.

In accordance with an aspect of the present invention, there is provided a method of producing a speech signal for generating a voice message containing at least two words. The method comprises the steps of sequentially reproducing: a. a first stored signal segment, the first segment for generating at least a beginning portion of a the first word of the two words; b. a second stored signal segment, the second segment for generating an end portion of the first word, a smooth transition to a second word of the two words, and a first portion of the second word; and c. a third stored signal segment, the third segment for generating at least an end portion of the second word.

In accordance with another aspect of the present invention, there is provided a method of storing speech signal segments for generating voice messages containing words in a dictionary of n words. The method comprises the steps of a.storing n beginning speech signal segments, each beginning segment for generating a beginning portion of a unique word in the dictionary; b. storing n end speech signal segments, each end segment for generating an end portion of a unique word in the dictionary; and c.storing n×n middle speech signal segments, each middle segment corresponding to a unique word pair in the dictionary, each middle segment for generating an end portion of an initial word in the pair, a smooth transition to the final word and a beginning portion of the final word. A signal for generating a voice message containing any first and second words in the dictionary may be generated from a selected beginning segment; a selected middle segment; and a selected end segment.

In accordance with yet another aspect of the present invention, there is provided a system for producing a speech signal for generating a voice message comprising words in a dictionary of n words. The system comprises: a processor and a memory device interconnected to the processor. The memory device comprises: n first memory portions each storing a signal segment for generating a beginning portion of a unique word in the dictionary; n second memory portions each storing a signal segment for generating an end portion of a unique word in the dictionary; n×n third memory portions, each storing a signal segment corresponding to a unique word pair in the dictionary and for generating an end portion of an initial word in the pair, a smooth transition to a final word in the pair, and a beginning portion of the final word. An output device is interconnected with the processor and the processor is adapted to select and provide the output device sequential signal segments selected from the first, second and third memory portions to produce the speech signal.

In accordance with yet another aspect of the present invention, there is provided a system for producing a speech signal for generating a voice message containing words and phrases in a dictionary. The dictionary comprises a plurality of system announcement messages and n key words. The system comprises: a processor; and a memory device interconnected to the processor. The memory device comprises n first memory portions each storing a signal segment for generating a beginning portion of a different word in the dictionary; n second memory portions each storing a signal segment for generating an end portion of a different word in the dictionary; n×n third memory portions, each storing a speech signal segment corresponding to a unique word pair in the dictionary and for generating an end portion of an initial word in the pair, a smooth transition to a final word in the pair, and a beginning portion of the final word; a plurality of fourth memory portions, each storing a speech signal segment for generating one of the system announcement messages. An output device is connected to the processor and the processor is adapted to select and provide the output device sequential signal segments selected from the first, second and third memory portions, and a speech signal segment selected from the fourth memory portions to produce said speech signal.

In accordance with another aspect of the present invention, there is provided a speech signal storage device for use in producing speech signals for generating words in a dictionary having n word entries, the device comprising: n×n memory portions, each storing a speech signal segment corresponding to a unique word pair in the dictionary and for generating an end portion of an initial word in the pair, a smooth transition to a final word in the pair and a beginning portion of the final word; whereby a signal for generating a sequence of words from the dictionary may be produced from signal segments sequentially reproduced from the n×n memory portions.

In accordance with another aspect of the present invention, there is provided a computer program stored on a computer readable medium. The computer program, is loadable into memory of a computer having a processor, and an output device interconnected with the processor. The program, when loaded into the memory forming n first memory portions each storing a signal segment for generating a beginning portion of a different word in a dictionary having n word entries; n second memory portions each storing a signal segment for generating an end portion of a different word in the dictionary; n×n third memory portions, each storing a speech signal segment corresponding to a unique word pair in the dictionary and for generating an end portion of an initial word in the pair, a smooth transition to a final word in the pair, and a beginning portion of the final word. The program adapts the processor to select and provide the output device sequential signal segments selected from the first, second and third memory portions to produce a speech signal containing words in then dictionary.

BRIEF DESCRIPTION OF THE DRAWING

In the figures which illustrate, by way of example, embodiments of the present invention, FIG. 1 schematically illustrates a system for producing speech signals in accordance with an aspect of the invention.

DETAILED DESCRIPTION

Figure 1:
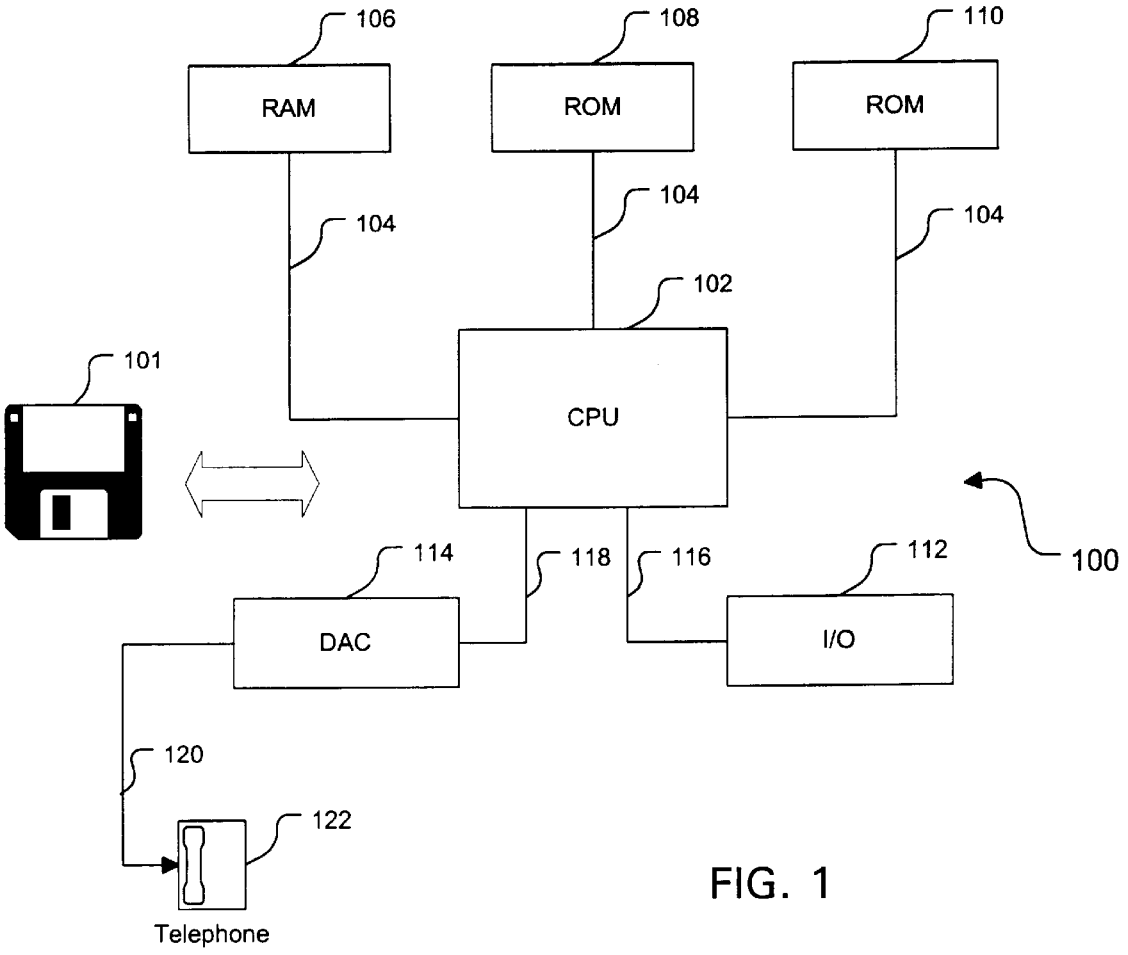

FIG. 1 schematically illustrates a system 100 for producing speech signals. System 100 comprises a central processing unit ("CPU") 102. Interconnected with CPU 102 by address and memory busses 104 is dynamic memory 106; data memory 108 and program memory 110. Input and output ("I/O") peripheral 112 and digital to analog converter ("DAC") 114 are further connected to CPU 102 by peripheral busses 116 and 118, respectively. A further input/output peripheral (not shown) may be interconnected with system 100. This input/output peripheral may be a disk or CD-rom drive for loading program instructions and data from a removable computer readable storage medium 101, like a diskette, CD-rom or ROM cartridge into memory 106, 108 or 110.

DAC 114 receives digital data and instructions from CPU 102 on bus 116, and produces an analog output signal at output 120, responsive thereto. DAC 114 may be any digital to analog converter capable of producing an analog speech signal from stored 64 kbps pulse code modulated ("PCM") data.

CPU 102 is a conventional microprocessor capable of providing instructions and data directing DAC 114 to generate a desired analog signal at output 120. Output 120 is connected directly, or indirectly to an analog audio device such as a speaker or a piezo electric element for generating an audible voice message. Typically, output 120 is interconnected indirectly, for example by way of a switch, or a private branch telephone exchange ("PBX") (not shown), to a telephone 122.

Dynamic memory 106 is random access memory ("RAM") used by CPU 102 for temporary storage of data. Program memory 110 comprises permanent program storage memory to store a series of processor instructions to direct execution of CPU 102. Data memory 108 stores data to be directed to DAC 18 to produce a desired analog signal at output 120. It will be understood that while dynamic, data and program memories 106, 108 and 110 have been schematically illustrated as physically separate from each other, they may in fact all be formed on a single device or integrated with CPU 102. Program and data memories 110 and 108 may be flash memory, EPROMs, CD-ROM, or any other suitable memory medium accessible by CPU 102. Of course, program and data memories 110 and 108 may also be dynamic RAM; necessary program and data may be loaded into such memories prior to use of system 100 using conventional techniques.

I/O peripheral 112 may comprise a conventional input/output port to interconnect system 100 to another processor or system. I/O peripheral 112 may, for example, be a conventional RS232 serial port. As detailed below, CPU 102 accepts data at I/O peripheral 112, and in response provides data to DAC 114. I/O peripheral 112 could similarly be integrated with CPU 102. Alternatively, I/O peripheral 112 could be eliminated entirely and CPU 102 could receive commands from other systems using shared memory. Similarly, CPU 102 could receive commands from another software process executing on system 100 using process to process communication techniques.

Figure 2:
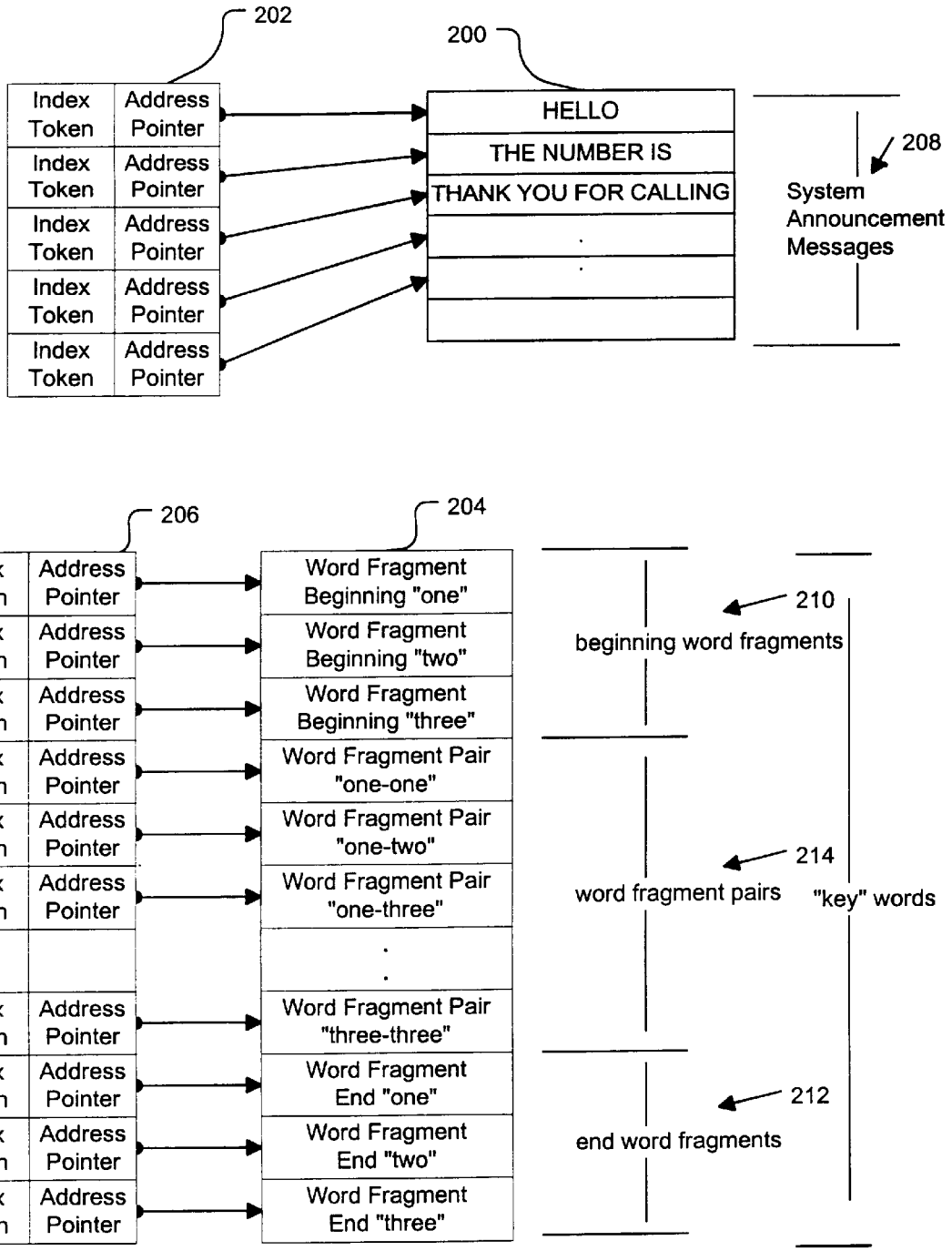
FIG. 2 illustrates the organization of a portion of memory used in the system of FIG. 1.

FIG. 2 illustrates the organization of data within data memory 108. Stored within data memory 108 are data tables 200 and 204. Data tables 200 and 204 each contain a plurality of entries 208, 210, 212, and 214. Each entry comprises a speech signal segment. Specifically, each of entries 208, 210, 212 and 214 contains data in 64 kbps PCM format to allow DAC 114 to generate a voice message segment from a speech signal segment. The individual speech signal segments when properly combined allow the generation of voice messages containing a sequence of words or phrases chosen from a dictionary.

The contents of the dictionary is user defined and typically application specific. The to dictionary may comprise the words corresponding to the sounded letters A–Z; the digits 0–9, as sounded (ie "won", "too", "three" four", etc.); pauses of a specified length; punctuation symbols, as sounded ("dash", "hyphen", "period", etc.); specific words; or any combination of these. The entries of the dictionary are chosen to allow the generation of numerous meaningful voice messages containing word sequences comprised of individual words or phrases from the dictionary.

The contents of the dictionary need not explicitly be stored in system 100. Instead, a "command tokens" may represent each word or phrases in the dictionary are stored within the system 100. The mapping of dictionary entries to tokens need only be known to a programmer or another system that can utilize this mapping to provide specific instructions to system 100.

In system 100, words or phrases within the dictionary are classified as either 1) system announcement messages; or 2) "key" words. System announcement messages are typically introductory phrases or valedictions, used to preface or follow a group of related and typically information containing words ("key" words). In the illustrated embodiment, the dictionary contains "key" words representing the digits "one", "two" and "three". Additional typical system announcement phrases such as "HELLO", "THE NUMBER IS" and "THANK YOU FOR CALLING" are also part of the dictionary. It will be understood that the system announcement messages may include pauses and single word phrases. Similarly "key" words could include phrases. In a preferred embodiment, the dictionary will comprise the digits 0–9, and a wide variety of phrases to allow production of speech signals to generate voice messages containing typical telephone directory assistance information. The numbers 0–9 allow for the generation of a voice message containing any telephone number. As well, system announcement message might include phrases such as "the number is"; "have a nice day"; "press pound to repeat", variable length pauses, and the like.

As illustrated in FIG. 2, data corresponding to the system announcement messages is stored within table 200. For each system announcement message, one entry of entries 208 (ie. one array) of table 200, contains 64 kbps PCM data, sufficient to generate a voice message containing that system announcement message in its entirety. Each entry 208 may be formed by digitally sampling a spoken version of the associated system announcement message and storing those samples using known techniques. As will be appreciated, the length of each entry 208 within table 200 will vary depending on the length of the system announcement message.

Known speech systems similarly store speech signal segments, each segment for generating a voice message containing an entry in a dictionary of phrases. One such system, for example, is disclosed in U.S. Pat. No. 5,029,200. However, in the system 100, data stored in data memory 108 is not only sufficient to generate voice messages containing individual words in the dictionary, apparently spoken in isolation, but is also sufficient to produce signals that generate a voice message containing two or more sequential "key" words with smooth transitions between "key" words.

"Key" words may be thought of those words that form the portion of the voice message to be generated by the speech signal produced by system 100 that may be most greatly varied. For example, in the telephony context, a generated voice message may contain an introductory phrase (a system announcement message), chosen from a few introductory phrases, followed by a series of numerals ("key" words), potentially representing a dollar amount or a telephone number. The message may conclude with a valediction or completing phrase (another system announcement message), which like the introductory phrase is chosen from a few completing phrases.

For each "key" word in the dictionary, data table 204 contains entries 210, 212 and 214 corresponding to word fragments. Entries 210 correspond to word fragments, formed from the beginning portion of each "key" word in the dictionary. Entries 212 correspond to word fragment, formed from the end portion of each "key" word in the dictionary. Entries, 210, 212 like those entries 208 of table 200, contain 64 kbps PCM data sufficient to generate voice message segments containing the associated speech segments (ie. a beginning or end word fragment). Voice message segments may be concatenated to form voice messages. Entries corresponding to complementary beginning and end word fragments may be sequentially reproduced to form a signal to generate the entire "key" word.

Further, table 204 contains entries 214 used to generate voice message segments containing an end of one word, a transition to the another "key" word in the dictionary, and the beginning portion of the other "key" word for all pairs of words in the dictionary. These entries may be thought of as corresponding to word pair fragments.

As will be appreciated for a dictionary having n "key" words or phrases, table 204 has n entries 210 (or arrays) corresponding to n beginning word fragments. Similarly, table 204 contains n entries 212, corresponding to n end word fragments. Additionally, table 204 contains n×n entries 214, corresponding to word pair fragments (corresponding to the end of one word in the dictionary followed, a transition to a second word in the dictionary and the beginning of that other word in the dictionary). Thus, for a system having a dictionary with n "key" words table 204 contains $n^2+2n$ entries. As such, the total memory required to store signal segments corresponding to beginning word, end word, and word pair fragments for "key" words is greater than simply storing PCM data corresponding to each entire word. However, any sequence of two or more "key" words may be smoothly reproduced from these $n^2+2n$ entries. This is a more than adequate compromise to storing all possible sequences of words. For example, in the preferred embodiment, seven or ten digit telephone numbers are typically reproduced. Storing all possible sequences, having smoothly interrelated spoken numerals would require significantly more memory than is required by the $n^2+2n$ entries.

The length of each of entries 210, 212 and 214 and signal segments in table 204 will depend on the length of each beginning "key" word fragment, end "key" word fragment, and word pair fragment. For the numerals "one", "two" and "three" the length of each beginning and end "key" word fragment is between 188 ms and 375 ms, corresponding to an entry and signal segment having between 1500 and 3000 bytes of 64 kbps PCM data. For the words "one", "two" and "three", each of entries 214 corresponding to a word pair fragment consists of between 2000 and 4000 bytes of data. Of course, depending on the desired quality and speed of the reproduced speech more or less data may be required for each entry.

As will be apparent, each data table 200 and 204, may be viewed as a two dimensional array. Further, stored within data memory 108 are index tables 202 and 206. Index tables 202 and 206 contain identifiers and memory pointers to point to addresses of entries 208, 210, 212 and 214 within tables 200 and 204, respectively. Specifically, index table 202 contains index entries each of which contains an index token, uniquely identifying one of entries 208 within table 200, and an address pointer, pointing to the beginning memory address of that entry within the table 200. Similarly, table 206 contains index tokens and addresses identifying and pointing to entries 210, 212 and 214 within table 204. Each token may be a unique byte or word, uniquely identifying a signal segment. As well, tables 202 and 206 could contain data representative of the length of each associated entry.

Figure 3A:
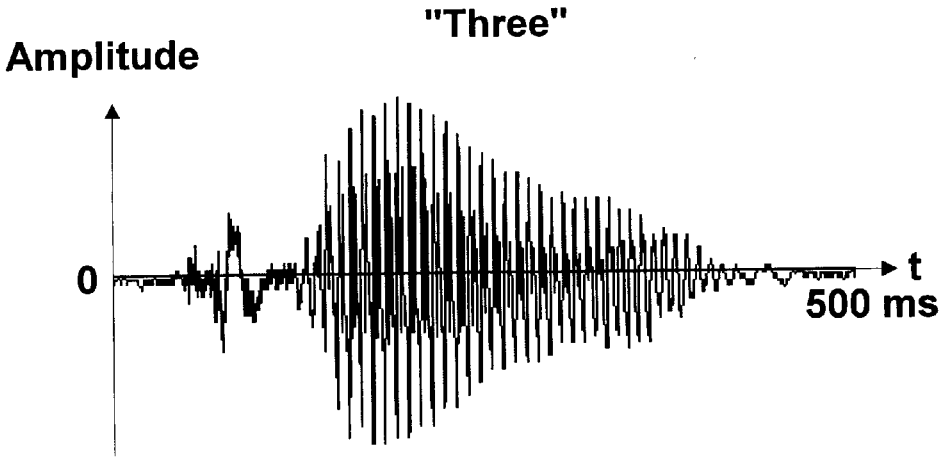
FIG. 3 is a graphic representation (amplitude v. time) of three analog voice message segments.
Figure 3B:
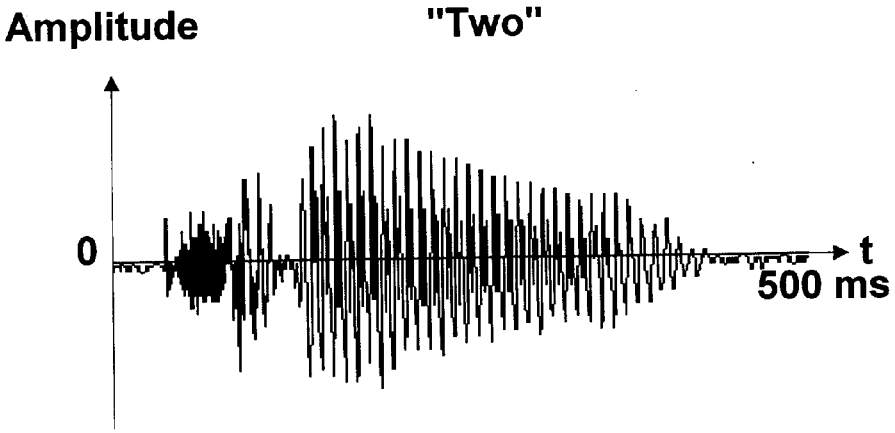
Figure 3C:
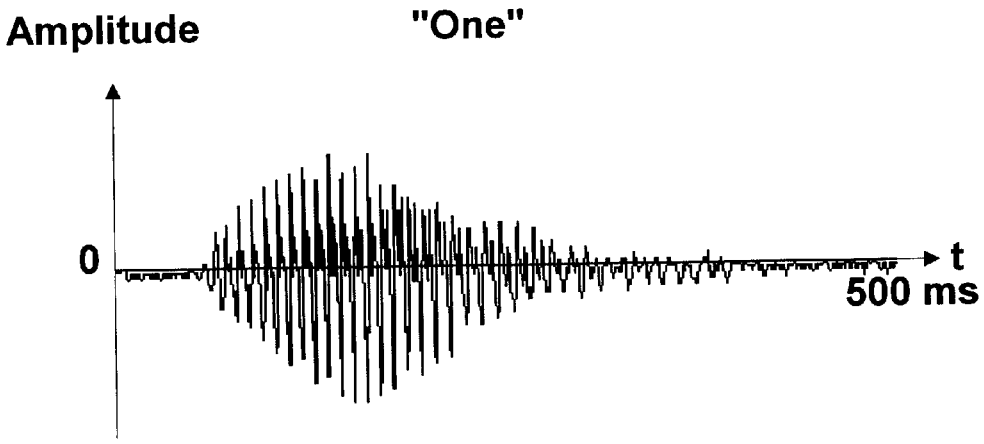

To better understand the nature, arrangement, formation and storage of entries in table 204, FIG. 3 graphically illustrates three analog voice signals for voice message segments (amplitude v. time) each containing one of the spoken words "three", "two" and "one", spoken independently of one another by the same speaker. Each spoken word has a duration of approximately 500 ms. For each word, a digital signal segment could be produced. Each signal segment could be formed by sampling each word, and storing the sampled data in known u-Law or A-law PCM format. Each such signal segment could be stored using approximately 4000 bytes (500 ms*64 kbps) of computer memory. A voice message containing a sequence of words could be produced from sequentially reproduced signal segments corresponding to each word in the sequence. This approach, however, does not take into account the natural interrelation between words, when spoken by a human being. Voice messages containing word sequences generated from signal segments so formed typically sound disjointed, "robotic" or staccato.

Figure 4:
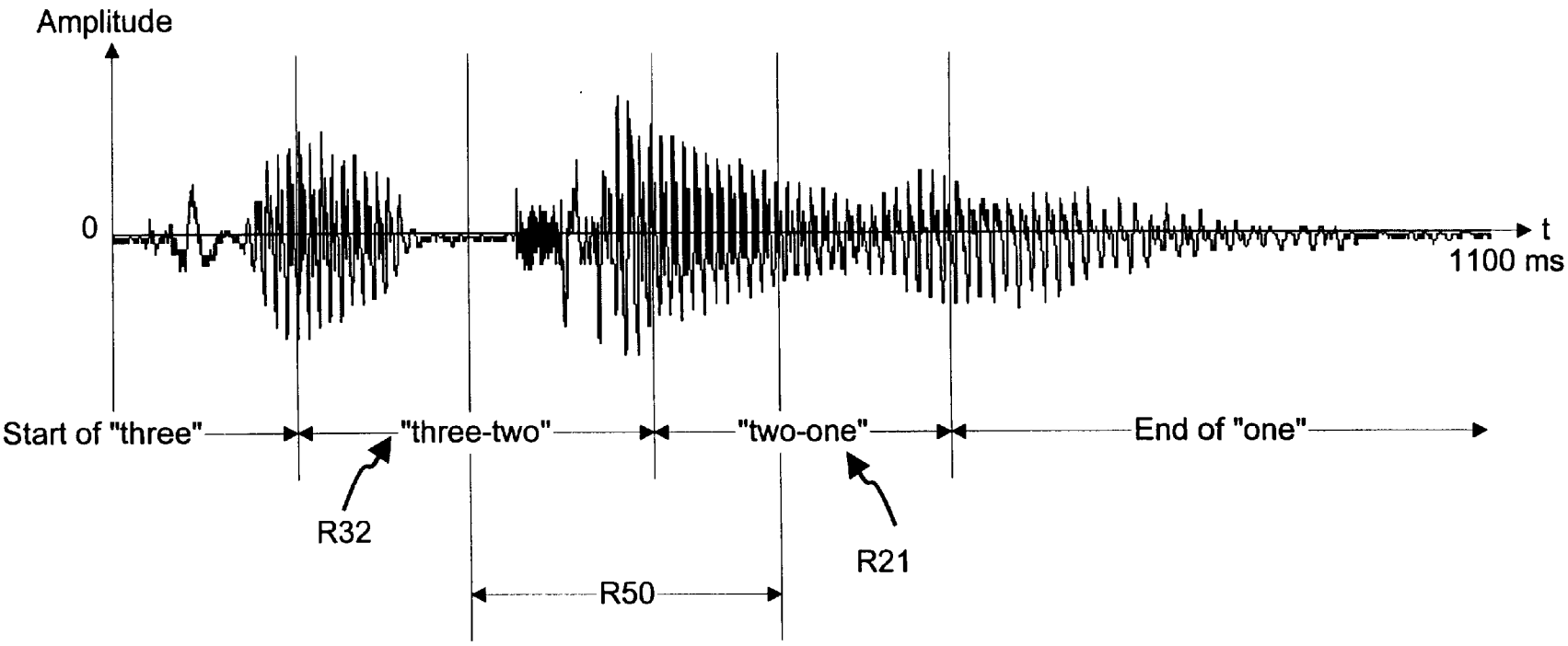
FIG. 4 is a graphic representation (amplitude v. time) of an analog voice message comprised of three words.

Instead, for "key" words within the dictionary, signal segments stored in entries 208, 210 correspond to word fragments and word pair fragments. To better understand the use of signal segments that correspond to word fragments and word pair fragments, FIG. 4 illustrates a analog voice signal (amplitude v. time) for a voice message containing sequentially spoken words "three two one", as naturally spoken. As shown in regions R32, and R21, the transition between spoken words is not a perfect gap of silence, as would be formed by generating a message from speech signal segments corresponding to the unrelated words "three", "two", "one" illustrated in FIG. 3. As well, the duration of the voice message containing the three sequentially spoken words, as illustrated in FIG. 4 is only approximately 1100 ms. This is approximately 400 ms shorter than a voice message generated from a speech signal produced from the sequential reproduction of signal segments corresponding to the voice message segments, of FIG. 3. Of course, this reduction in the length of the message is only representative of the illustrated example. The reduction may be greater or less depending on a number of factors. For example, the typical rhythm and speed of the words recorded to form the stored fragments will influence the length of the voice message.

Conceptually, each word in a naturally spoken sequence, may be modelled as comprising three signal regions: an initial region that is related to a previously spoken word; a closing region related to the subsequently spoken word; and a middle region, correlated to neither the previous, or subsequent spoken word. Moreover, a word spoken in isolation may similarly be modelled by initial, closing and middle regions.

Figure 5:
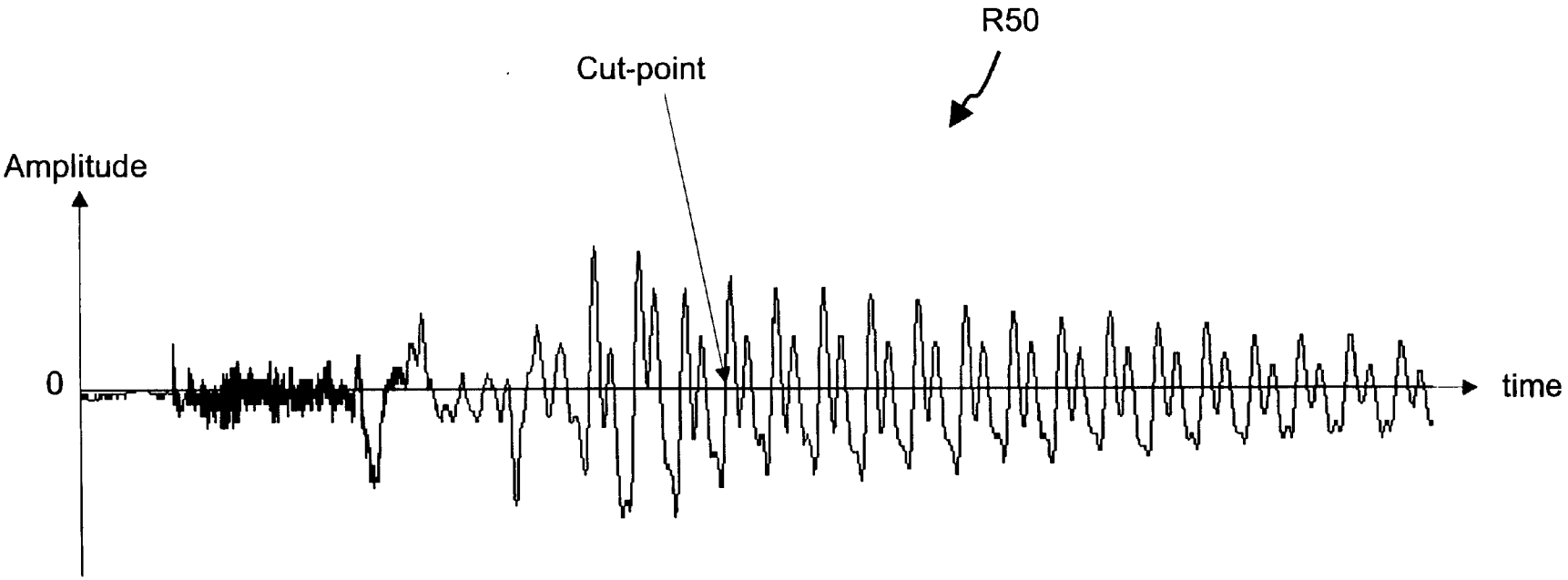
FIG. 5 is an enlargement of a portion of FIG. 4.

Signal segments stored in table 204 are formed using this model. Specifically, signal segments corresponding two "key" words or "key" word pair fragments are formed by sampling analog signals for two sequentially spoken "key" words, as illustrated in FIG. 4. Each signal segment corresponding to a word pair is formed by storing a portion of the sampled word sequence including the transition from the first word to the next. For example, signal segments corresponding to regions R32 and R21 would form entries 212 corresponding to word pair fragments for the word pair pairs "three-two" and "two-one". Conveniently, each word pair fragment signal segment begins with data sampled from the uncorrelated middle region of the first word. Similarly, each word pair fragment signal segment ends with data sampled in the unrelated middle region of the second word. An enlargement of region R50 in FIG. 5 illustrates an appropriate dividing or "cut" point for forming the "three-two" and "two-one" word pair fragments.

Further entries 208 of table 204 (FIG. 2) comprise signal segments corresponding to beginning and end word fragment. The beginning word fragment signal segments are formed by sampling analog signals of "key" words, spoken in isolation, as exemplified in FIG. 3. Samples corresponding to the beginning portion of the word are stored. Enough samples are stored in each entry, so that an entire "key" word may be reproduced, from the beginning word fragment signal segment and a word pair signal segment commencing with data samples from that "key" word.

Thus, conveniently, an entry corresponding to a beginning word fragment and a complementary entry corresponding to a word pair fragment could be concatenated to form a signal to generate a voice message containing an entire "key" word. As will be appreciated, a signal so formed, lacks a noticeable transition between signal segments. The signal would also contain a segment to generate a beginning word fragment for another "key" word.

Similarly, additional entries 210 of table 204 comprise signal segments corresponding to end word fragments. The end word fragment segment samples are also formed by sampling analog signals of "key" words, spoken in isolation, as illustrated in FIG. 3. However, the samples corresponding to the end portion of the word not stored in a corresponding beginning word fragment segment are stored. As such, the a voice message containing the entire "key" word spoken in isolation, may be generated from the beginning word fragment signal segment and the corresponding end word fragment signal segment.

For greater clarity, FIGS. 6(*a*)–6(*o*) illustrate analog amplitude v. time representations of voice message segments. These voice message segments are generated from signal segments that correspond to word fragments and word pair fragments for a dictionary comprised of the "key" words, "one", "two" and "three". For system 100, PCM representations of these signal segments form entries 210, 212 and 214 of table 204. Of course, for system 100, signal segments for other "key" words may be stored within data memory 108.

Figure 6A:
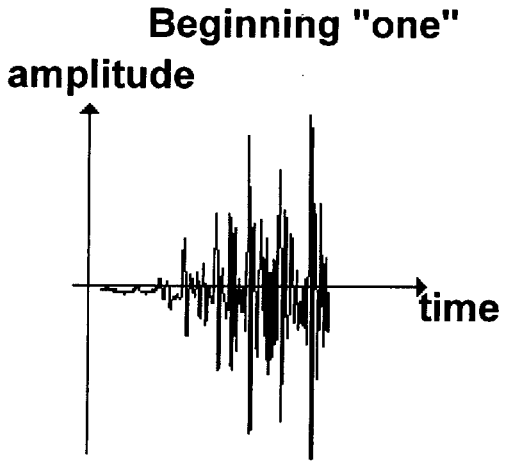
FIGS. 6(*a*)–6(*o*) are graphic representations (amplitude v. time) of multiple voice message segments corresponding to fragments of "key" words in a dictionary.
Figure 6B:
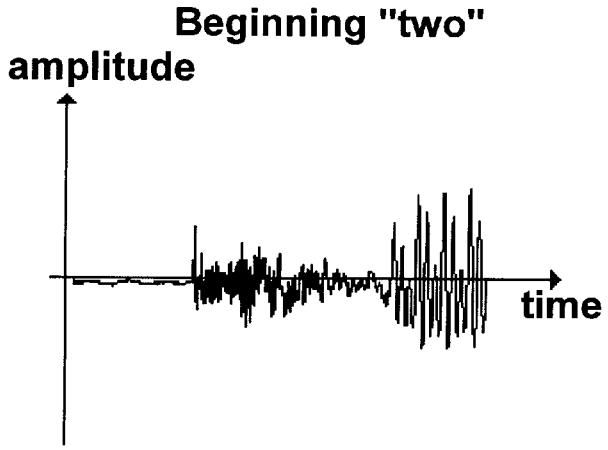
Figure 6C:
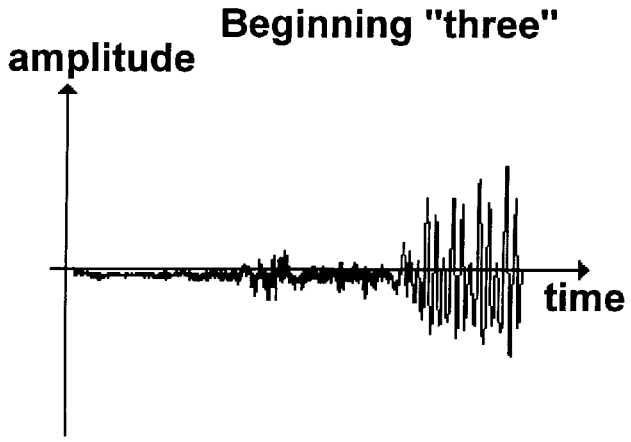
Figure 6D:
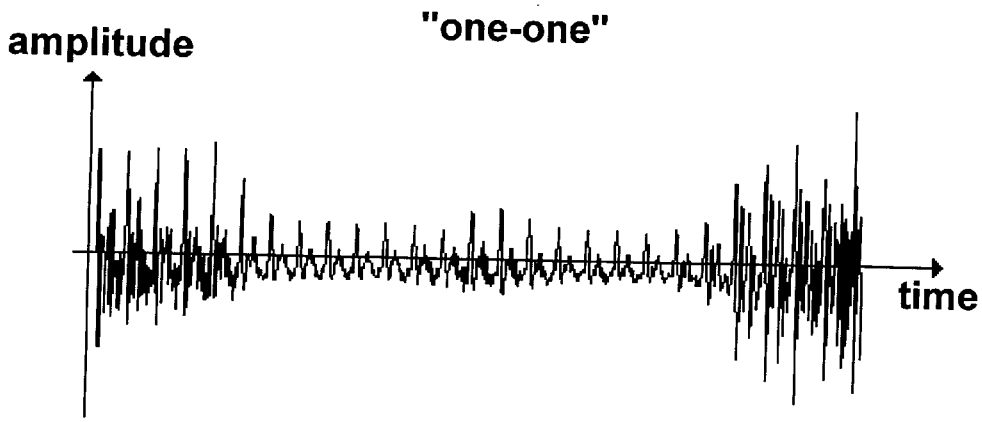
Figure 6E:
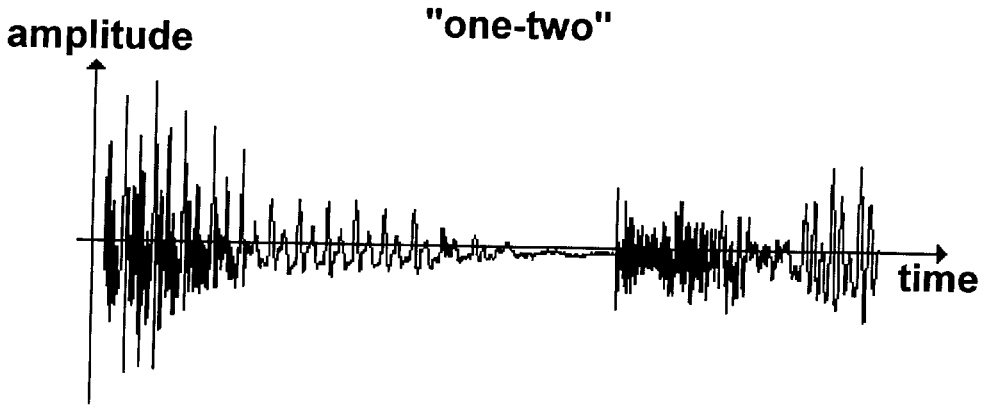
Figure 6F:
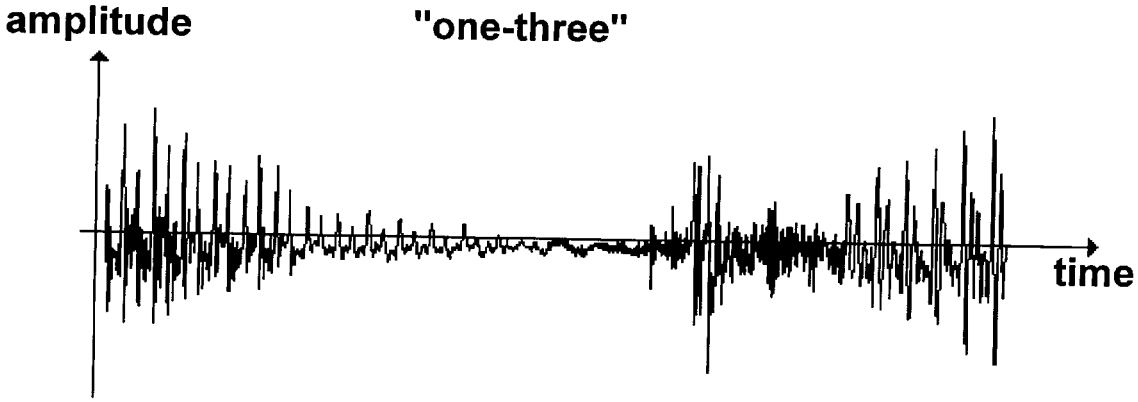
Figure 6G:
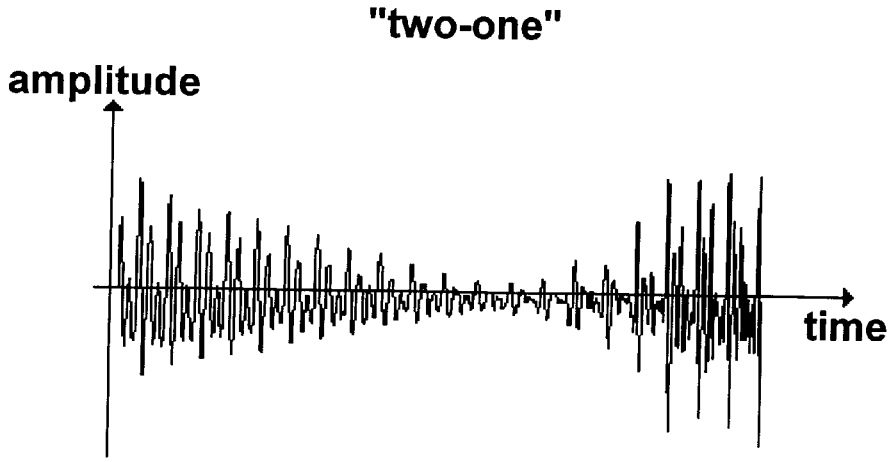
Figure 6H:
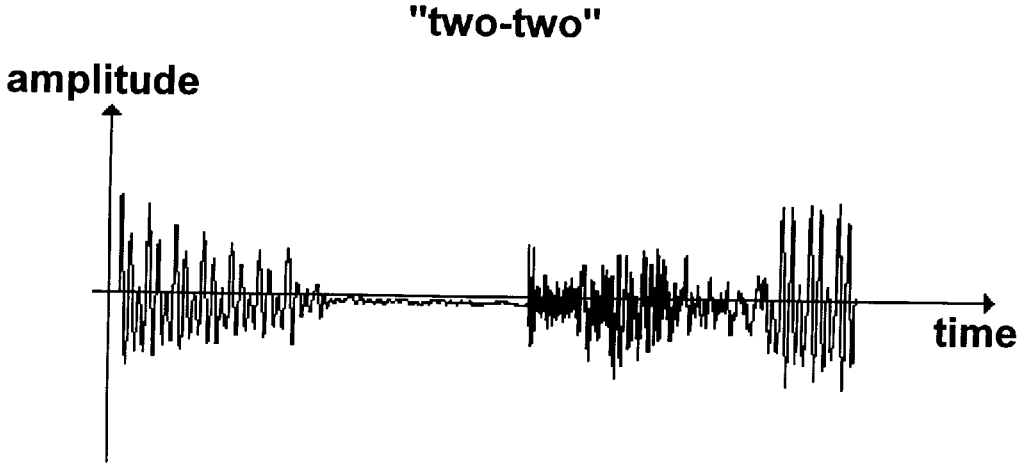
Figure 6I:
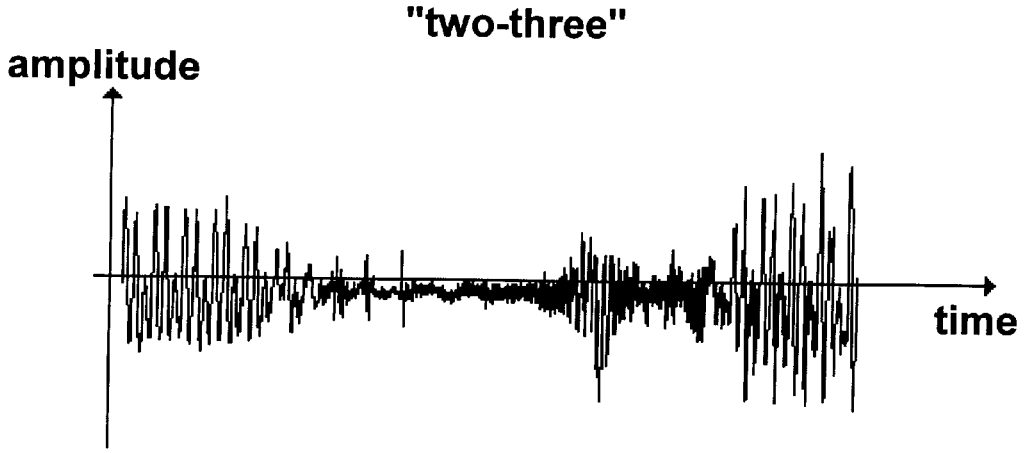
Figure 6J:
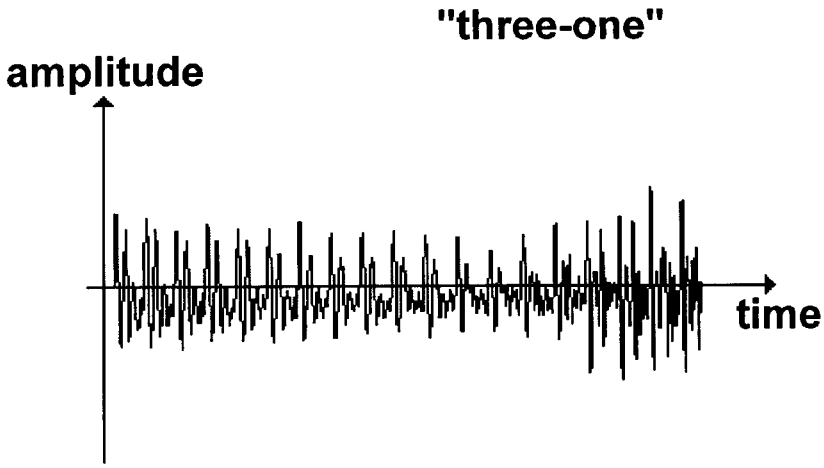
Figure 6K:
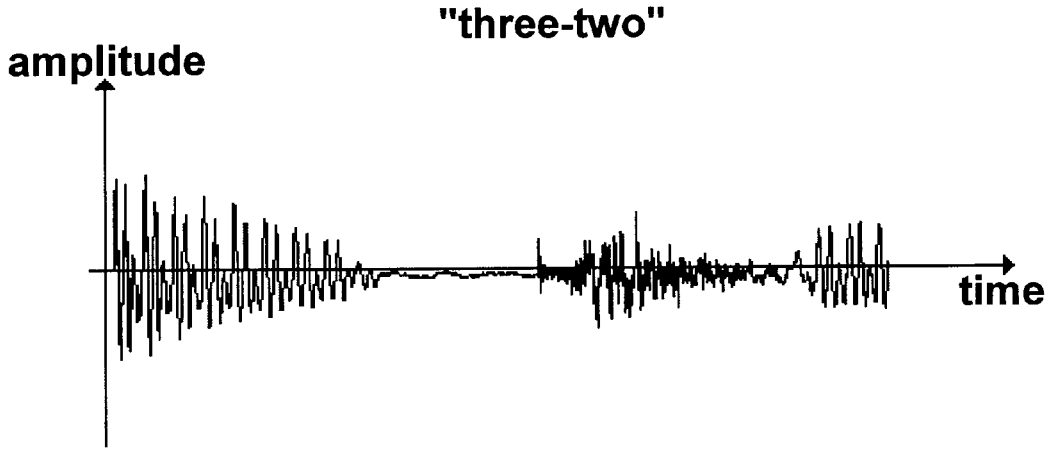
Figure 6L:
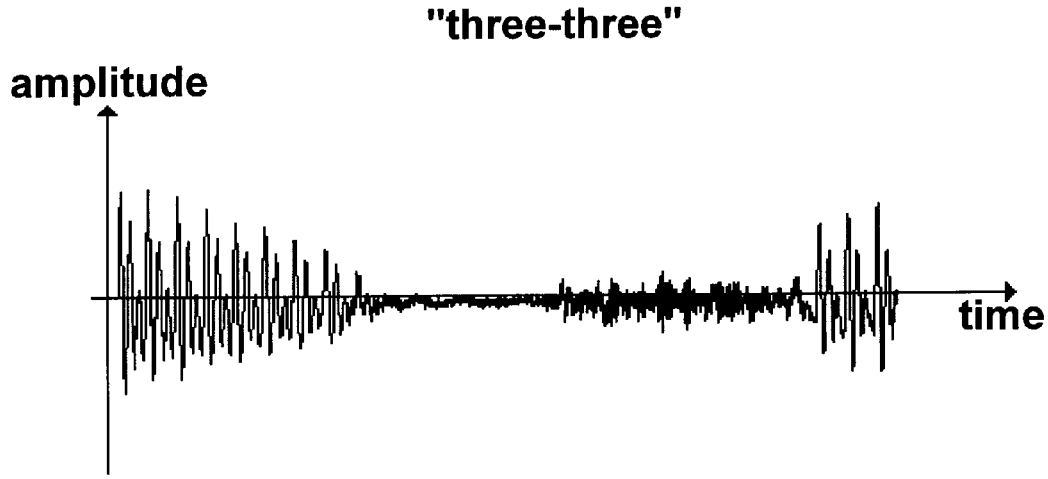
Figure 6M:
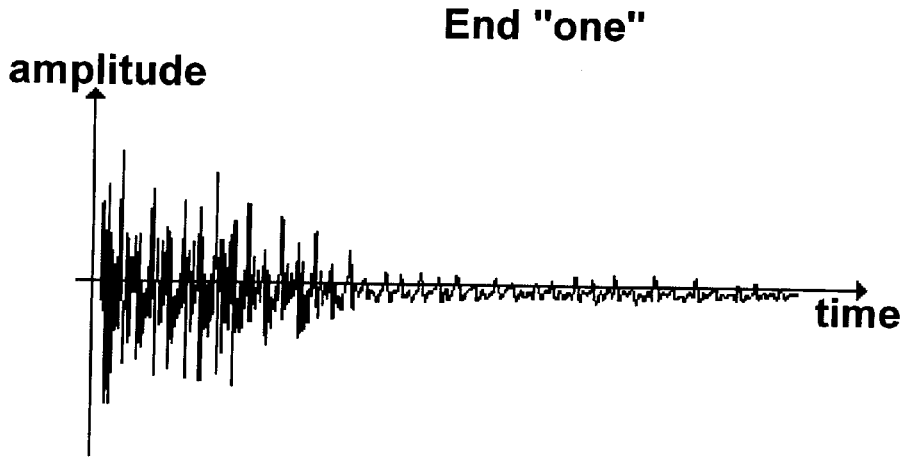
Figure 6N:
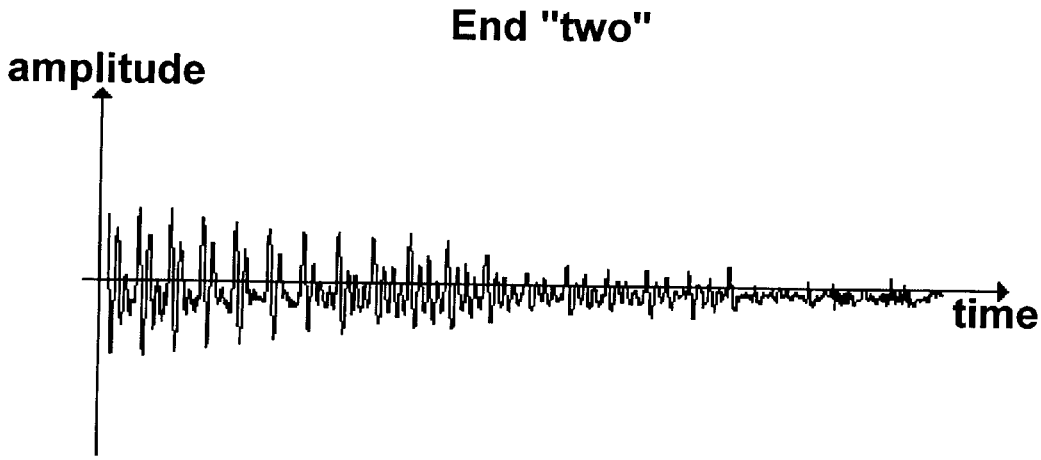
Figure 6O:
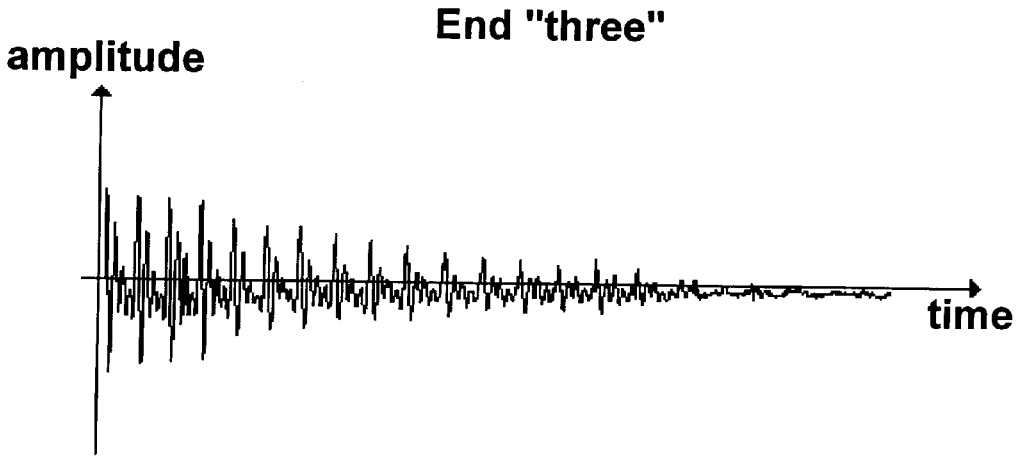

FIGS. 6(a)–6(o) corresponding to the following word and word pair fragments:

| FIG. | Word Fragment |
|---|---|
| 6(a) | Beginning "one" |
| 6(b) | Beginning "two" |
| 6(c) | Beginning "three" |
| **FIG.** | **Word Fragment** |
| 6(m) | End "one" |
| 6(n) | End "two" |
| 6(o) | End "three" |
| **FIG.** | **Word-Pair Fragment** |
| 6(d) | "one-one" |
| 6(e) | "one-two" |
| 6(f) | "one-three" |
| 6(g) | "two-one" |
| 6(h) | "two-two" |
| 6(i) | "two-three" |
| 6(j) | "three-one" |
| 6(k) | "three-two" |
| 6(l) | "three-three" |

Thus, using signal segments corresponding to the illustrated word and word pair fragments, signals for generating voice messages containing any combination of the "key" words "one", "two" and "three" could be produced. For example, a voice message containing the word sequence "1-223-3131" could be generated from a signal produced by sequentially reproducing and thus concatenating signal segments corresponding to FIGS.,

6(*a*) (beginning one); 6(*m*) (end one); 6(*b*) (beginning two);6(*h*) (pair two-two); 6(*i*) (pair two-three); 6(*o*) (end three); 6(*c*) (beginning three); 6(*j*) (pair three-one); 6(*f*)(pair one-three); 6(*j*)(pair three-one); 6(*m*) (end one).

Because the signal segments corresponding to word pair fragments, (FIGS. 6(*d*)–6(*j*)), take into account the correlation between the two words in the pair, production of voice messages from segments corresponding to these word-pair fragments generate a smooth, natural sounding transition between words. Voice messages containing word sequences generated from signal segments corresponding to these word pair fragments lack the staccato, or robotic pauses created by the reproduction of individual, unrelated word recordings. Moreover, the overall voice message takes less time to generate as pauses between words are not as long as deliberately generated pauses between words.

Deliberate pauses, represented in the above example by hyphens, may be generated by generating two subsequent words from signal segments corresponding to the end word fragment for the first word and the beginning word fragment for the second word, instead of the word pair fragment for the "first word—second word" pair. In order to generate longer pauses it may be desirable to include a gap or pause between two words so generated (the numbers "one", and "two" in the above example). This gap could be generated by system 100 by including a pause as a dictionary word. A corresponding system announcement message signal segment could be stored in table 200.

It is worth noting that the signals representing beginning portions (ie. first 10+ ms) of voice message segments corresponding to word pairs beginning with "one" (ie. corresponding to FIGS. 6(*d*), 6(*e*) and 6(*f*)) are extremely similar. These are also extremely similar to signals representing the beginning portions (ie. first 10+ ms) of voice message segments corresponding to the end word pair fragment "one" (FIG. 6(*m*)). Likewise, signals corresponding to the end portions (last 10− ms) of voice message segments for word fragment pairs ending with "one" (ie. FIGS. 6(*d*), 6(*g*), and 6(*f*)) are extremely similar to each other and to the end portion (10− ms) of signals corresponding to voice message segments with the beginning word fragment "one" (ie. FIGS. 6(*a*)). Similar observations may be made for signals representative of voice message segments corresponding to word fragments and word pair fragments commencing or ending with portions of the words "two" and "three". Moreover, beginning and end word fragments or word pair fragments, are complementary. Thus, voice messages generated from signal segments for generating a beginning word fragment for a first word, and a complementary signal segment for generating a word pair fragment contain the entire first word. Transition between segments is generally smooth, and may even be unnoticeable. This is similar for messages generated from signal segments for generating a word pair fragment ending in a second word and a complementary signal segment for generating a beginning word fragment.

As will be appreciated the PCM versions of the voice message segments as reproduced in FIGS. 6(*a*)–6(*o*) may be formed and stored as entries 210, 212 and 214 of table 200 within data memory 108 as part of the design of system 100. Alternatively, system 100 could be modified to allow input of analog signals through a microphone or the like. Software could then be developed which would prompt input of complete spoken "key" words. This input would be sampled, and signal segments corresponding to beginning and end word fragments and word pair fragments could be generated and stored within memory 108. Alternatively, such software need not form part of system 100, but could form part of another software system.

In operation, system 100 under program control of a subroutine/program stored within program memory 110 monitors I/O peripheral 112 for a command at I/O peripheral 112. This command may be provided by another system interconnected with system 100. For example, system 100 may be formed as an accessory module to a voice mail system and may receive commands from the main processor of the voice mail system.

Figure 7:
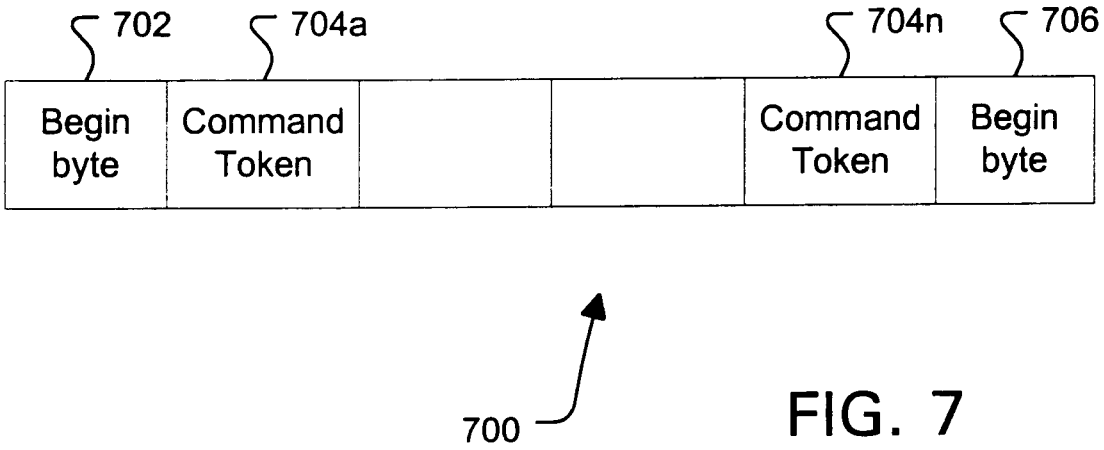
FIG. 7 illustrates the organization of a command received by the system of FIG. 1.

A typical command is illustrated as item 700 in FIG. 7. Each command 700 comprises a begin byte 702; a series of command tokens 704*a*–704*n* and an end byte 706. Command tokens 704*a*–704*n* may be bytes or words of data representative of word or phrases in the dictionary and the speech segment to be produced by system 100. Each command token 704*a*–704*n* represents a separate word or phrase within the dictionary and within the signal to be produced. CPU 102 upon receipt of the command 700 extracts the command tokens 704*a*–704*n* from command 700 and stores these command tokens 704*a*–704*n* in dynamic memory 106. For each token, CPU 102 under program control parses the sequence of command tokens 704*a*–704*n* to determine which speech segment or segments corresponding to the word should be reproduced from data stored in tables 200 and 204 of data memory 108 to produce a signal corresponding to the appropriate dictionary word or phrase associated with the token.

It is worth noting that the command tokens 704*a*–704*n* are not the same as the index tokens stored within tables 202 and 206. Command tokens 704*a*–704*n* identify words within the dictionary used by system 100. Index tokens in tables 202 and 206 identify signal segments corresponding to system announcement messages; beginning word fragments; end word fragments; and word pair fragments for "key" words within the dictionary. A conventional mapping technique may be used to extract appropriate index tokens for any word or phrase identified by a command token.

Figure 8:
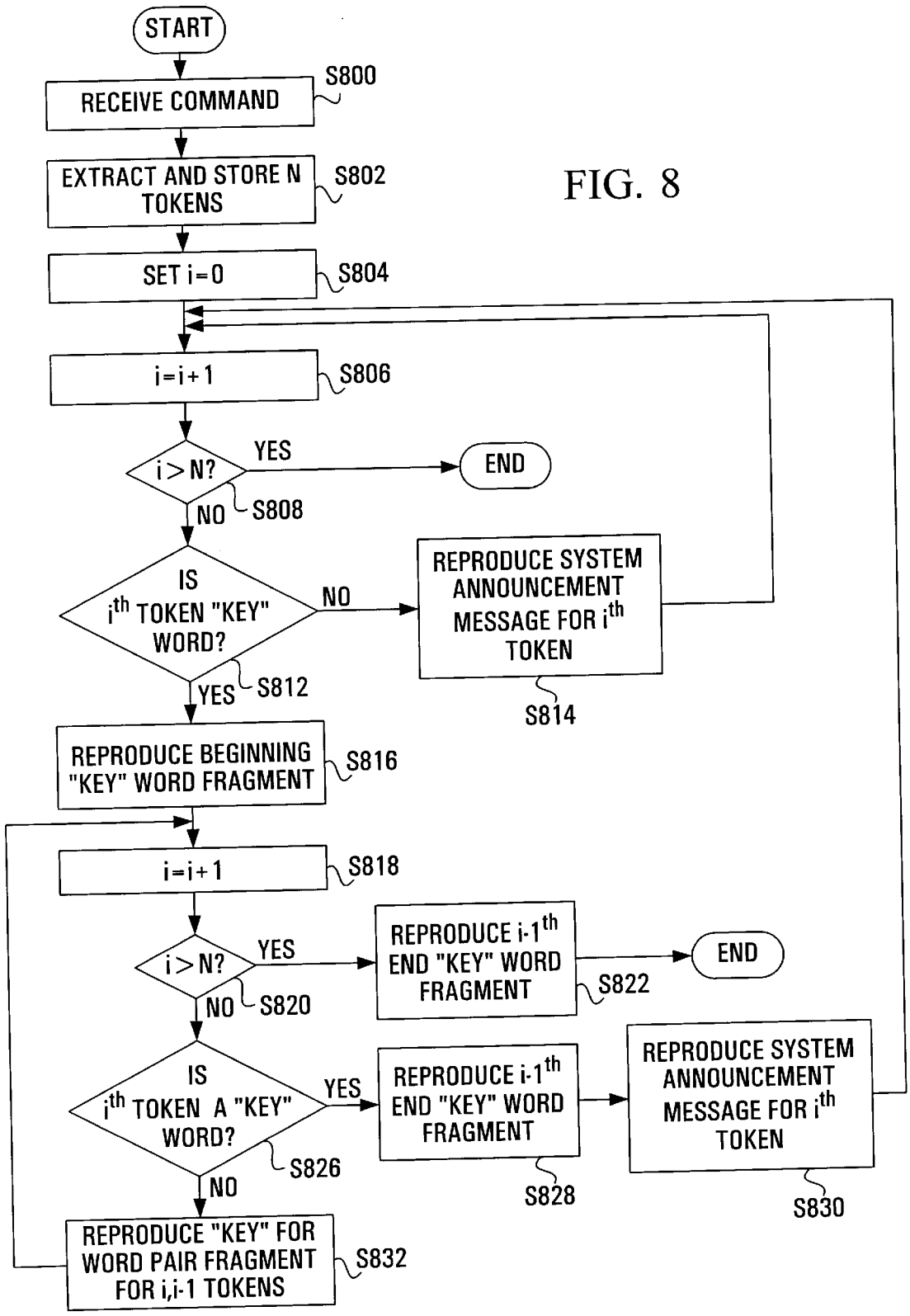
FIG. 8 is a flow chart of a method used by the system of FIG. 1.

A flowchart representing the receipt and processing of a command is illustrated in FIG. 8. In step S800 system 100 (FIG. 1) receives a command string 700 (FIG. 7) at I/O peripheral 112. As noted, the command string 700 comprises a start byte 702, command tokens 704*a*–704*n*, and an end byte 706. Each command token 704*a*–704*n* represents a word or phrase within the dictionary of system 100. In step S802, CPU 102 stores the command tokens in RAM 106, and ascertains the number of command tokens within command 700. This number is stored in a variable n, within RAM 106. Thereafter, in step S804, a counter i, also stored within RAM 106 is initiated with a value i=0. In step S806 this counter is incremented to a value of 1. Step S808 insures that the counter does not exceed the total number of tokens in the command. If the last token within a command is encountered the program exits or ends.

If the counter i does not exceed the total number of command tokens, the system decides in step S812 whether or not the current (ie. $i^{th}$) command token under consideration corresponds to a "key" word or a system announcement message. If the $i^{th}$ command token is representative of a system announcement message, CPU 102 in step S814 retrieves an index token from table 202 corresponding to the system announcement message represented by the command token. Thereafter also in step S814, an entry in table 200 corresponding to the system announcement message is extracted by CPU 102. This data along with the necessary DAC commands are provided by CPU 102 to DAC 114 along bus 118. DAC 114, in turn, reproduces the an analog signal corresponding to the system announcement message. It will be appreciated that DAC 114 need not form part of system 100, but may form part of another system which ultimately converts a signal produced by system 100 into an audible signal. System 100 may thus only generate a digital speech signal. Of course, DAC 114 or the other system could buffer data provided by CPU 102.

Additionally, it may be desirable to produce a deliberate pause after reproduction of the system announcement message m step S814. This could be accommodated by CPU 102 "waiting" a desired length after reproduction of the system announcement message. Alternatively, each of entries 208 corresponding to system announcement messages could conclude with PCM data to generate a pause. After completion of step S814, steps S806 and onward are repeated.

In the event the $i^{th}$ command token represents a "key" word, the command token is mapped to an appropriate index token for one of entries 210 within table 204 corresponding to the beginning word fragment for the word represented by the $i^{th}$ command token. Thereafter also in step S816, data from this entry is extracted by CPU 102 utilizing the appropriate index entry from table 206. The data for this signal segment along with the necessary DAC commands are provided by CPU 102 to DAC 114 along bus 118. DAC 114, in turn, reproduces an analog signal segment representative of the word fragment at its output 120.

Thereafter, counter i is incremented in step S818. Step S820 assesses whether the previous $i^{th}$ token was the $n^{th}$ and final command token 704*n* in command 700. If so, in step S822 the signal segment corresponding to an end word fragment of word represented by the $i\text{-}1^{th}$ token is retrieved from table 206 and an analog signal segment corresponding to this end word fragment is reproduced by DAC 114. The method then ends or exits.

If i has not been incremented beyond the total number of tokens in the command, CPU 102 assesses whether the now incremented $i^{th}$ token represents a "key" word. If so, an index token and pointer for the word pair fragment corresponding to the "key" words represented by the previous and present tokens (ie. $i^{th}$ and $i\text{-}1^{th}$) is generated. The entry in table 204 corresponding to this word pair fragment is extracted and a signal corresponding to this word pair fragment is reproduced at DAC 114 in step S832. Steps S818 and onward are then repeated.

If the $i^{th}$ command token represents a system announcement message, an analog signal segment corresponding to the end word fragment for the $i\text{-}1^{th}$ token is reproduced at DAC 114 in step S828 and the system announcement message corresponding to the ith token is reproduced in step S830. Steps S806 and onward are then repeated.

As will be appreciated the reproduction of signal segments corresponding to word pair fragments, to reproduce transitions between sequential "key" words, results in audibly smooth transitions between "key" words at output 120. These audibly smooth transitions are more pleasing to the human ear. Moreover, these natural transitions allow for the quicker production of sequential "key" words, without deliberate and potentially lengthy pauses between "key" words and the required time to produce the transition to the pauses.

While the method flowcharted in FIG. 8 has been described as a self-contained routine, it will appreciated that this method may be a subroutine of a larger program. Similarly, the method may be initiated in response to a hardware interrupt caused by the receipt of a command at I/O peripheral 112. This would obviate the need to monitor I/O peripheral 112 for receipt of a message.

Similarly, while the dictionary of system 100 has been described as containing system announcement messages and "key" words, the system 100 could easily be modified to accommodate "key" phrases. With appropriate modification, beginning, middle and end "key" phrase fragments could be stored within data memory 108. In such a modified form, the smooth transition between words would comprise additional words in a "key" phrase.

In order to further enhance the realism of the produced speech, the dictionary of system 100 may contain various versions of the same word, having different intonations. For each word, for example, a version having rising, falling and level intonation can be stored. Thus, if j versions of each "key" were stored, a total of $jx(n^2+2n)$ segments could be stored. The method of FIG. 8 may be enhanced to assess whether a "key" word is to be generated at the beginning, in the middle or at the end of sequence of "key" words. Alternatively, the system originating command tokens 704*a*–704*n* could utilize tokens representing "key" words having rising, falling or level intonation to create a command string, which when interpreted by system 100 would result in a further enhanced, natural sounding speech.

It will of course be understood that system 100 may form part of a larger computing/processing system. In such a larger system each of the components of system 100 could serve multiple functions not detailed herein. For example, system 100 could form an integral part of a telephone voice mail system, switch, PBX or the like. CPU 102; DAC 114; memory 106, 108 and 110; and I/O peripheral 112 could be further adapted to store and replay user messages, manage telephone calls and provide a variety of other features. It is envisioned that the system and method disclosed could form part of an existing voice mail product such as Nortel's Meridian Mail and Norstar VM products.

As well, a person skilled in the art will appreciate that while system 100 stores PCM voice data, the system 100 may be adapted to store other data formats representative of voice signals. For example, signal segments could be compressed prior to storage using other voice compression techniques and DAC 114 or CPU 102 may be adapted to produce a corresponding analog signal from the compressed data, and may thus incorporate any one of a number of know codes.

It will be understood that the invention is not limited to the illustrations described herein which are merely illustrative of a preferred embodiment of carrying out the invention, and which are susceptible to modification of form, arrangement of components, and details and order of operation. The invention, rather, is intended to encompass all such modification within its spirit and scope, as defined by the claims.

I claim:

1. A method of storing speech signal segments for generating voice messages containing words in a dictionary of n words, said method comprising the steps of a. storing n beginning speech signal segments, each beginning segment for generating a beginning portion of a unique word in said dictionary;

b. storing n end speech signal segments, each end segment for generating an end portion of a unique word in said dictionary;

c. storing n×n middle speech signal segments, each middle segment corresponding to a unique word pair in said dictionary, each middle segment for generating an end portion of an initial word in said pair, a smooth transition to a final word in said pair; and a beginning portion of said final word;

wherein a signal for generating a voice message containing any first and second words in said dictionary may be generated from a selected one of said n beginning speech signal segments; a selected one of said n×n middle speech signal segments; and a selected one of said n end speech signal segments.

2. The method of claim 1, wherein a signal for generating a voice message containing any word in said dictionary may be produced from a beginning segment and a corresponding end segment.

3. A speech signal storage device for use in generating voice messages containing words in a dictionary having n word entries, said device comprising:

n first memory portions, each storing a signal segment for generating a beginning portion of a unique word in said dictionary;

n second memory portions, each storing a signal segment for generating an end portion of a unique word in said dictionary;

n×n third memory portions, each storing a speech signal segment corresponding to a unique word pair in said dictionary and for generating an end portion of an initial word in said pair, a smooth transition to a final word in said pair, and a beginning portion of said final word wherein any first and second word in said dictionary may be generated from a signal segment selected from one of said first memory portions; a signal segment selected from one of said third memory portions; and a signal segment selected from one of said second memory portions.

4. The device of claim 3, wherein a voice message containing any word in said dictionary may be generated from a signal segment stored in a first memory portion and a complementary signal segment stored in a second memory portion.

5. A system for producing a speech signal for generating a voice message comprising words in a dictionary having n words, said system comprising:

a processor;

a memory device interconnected to said processor;

said memory device comprising:

n first memory portions each storing a signal segment for generating a beginning portion of a unique word in said dictionary;

n second memory portions each storing a signal segment for generating an end portion of a unique word in said dictionary;

n×n third memory portions, each storing a signal segment corresponding to a unique word pair in said dictionary and for generating an end portion of an initial word in said pair, a smooth transition to a final word in said pair, and a beginning portion of said final word;

an output device connected to said processor;

wherein said processor is adapted to select and provide said output device signal segments selected from said first, second and third memory portions to produce said speech signal and wherein any first and second word in said dictionary may be generated from a signal segment selected from one of said first memory portions; a signal segment selected from one of said third memory portions; and a signal segment selected from one of said second memory portions.

6. The system of claim 5, further comprising an input device interconnected to said processor, said input device adapted to receive and provide commands to said processor to produce speech signals at said output device.

7. The system of claim 5, further comprising a plurality of fourth memory portions, each fourth memory portion storing a speech signal segment for generating a system announcement message.

8. The system of claim 6, wherein said output device comprises a digital to analog converter.

9. A system for producing a speech signal for generating a voice message containing words and phrases in a dictionary, said dictionary comprising a plurality of system announcement messages and n key words, said system comprising:

a processor;

a memory device interconnected to said processor;

said memory device comprising:

n first memory portions each storing a signal segment for generating a beginning portion of a different word in said dictionary;

n second memory portions each storing a signal segment for generating an end portion of a different word in said dictionary;

n×n third memory portions, each storing a speech signal segment corresponding to a unique word pair in said dictionary and for generating an end portion of an initial word in said pair, a smooth transition to a final word in said pair, and a beginning portion of said final word;

a plurality of fourth memory portions, each storing a speech signal segment for generating one of said system announcement messages;

an output device interconnected with said processor;

wherein said processor is adapted to select and provide said output device sequential signal segments selected from said first, second and third memory portions, and a speech signal segment selected from said fourth memory portions to produce said speech signal.

10. A speech signal storage device for use in producing speech signals for generating a voice message containing words from a dictionary having at least n word entries, said device comprising:

n×n memory portions, each storing a speech signal segment corresponding to a unique word pair in said dictionary and for generating an end portion of an initial word in said pair, a smooth transition to a final word in said pair and a beginning portion of said final word;

whereby a signal for generating a sequence of words from said dictionary may be produced from signal segments sequentially reproduced from said n×n memory portions.

11. A speech signal storage device for use in generating voice messages containing words in a dictionary having n word entries, said device comprising:

n first memory portions, each storing a signal segment for generating a beginning portion of a unique word in said dictionary;

n second memory portions, each storing a signal segment for generating an end portion of a unique word in said dictionary;

n×n third memory portions, each storing a speech signal segment corresponding to a unique word pair in said dictionary and for generating an end portion of an initial word in said pair, a smooth transition to a final word in said pair, and a beginning portion of said final word.

12. A computer program stored on a computer readable medium, said computer program, loadable into memory of a computer having a processor, and an output device interconnected with said processor, said program when loaded into said memory forming n first memory portions each storing a signal segment for generating a beginning portion of a different word in a dictionary having n word entries;

n second memory portions each storing a signal segment for generating an end portion of a different word in said dictionary;

n×n third memory portions, each storing a speech signal segment corresponding to a unique word pair in said dictionary and for generating an end portion of an initial word in said pair, a smooth transition to a final word in said pair, and a beginning portion of said final word;

said program adapting said processor to select and provide said output device sequential signal segments selected from said first, second and third memory portions to produce a speech signal containing words in said dictionary, wherein any first and second word in said dictionary may be generated from a signal segment selected from one of said first memory portions a signal segment selected from one of said third memory portions; and a signal segment selected from one of said second memory portions.

* * * * *